United States Patent [19]

Chavkin et al.

[11] Patent Number: 4,972,974

[45] Date of Patent: Nov. 27, 1990

[54] CHILDPROOF DISPENSER

[75] Inventors: Leonard Chavkin, Bloomsbury, N.J.; Leonard Mackles, New York, N.Y.

[73] Assignee: Product Resources International, Inc., New York, N.Y.

[21] Appl. No.: 408,260

[22] Filed: Sep. 18, 1989

[51] Int. Cl.[5] ..... B65D 83/00

[52] U.S. Cl. ..... 222/153; 222/384; 222/402.11

[58] Field of Search ..... 222/153, 384, 402, 402.11; 220/353

[56] References Cited

U.S. PATENT DOCUMENTS

| | | | |
|---|---|---|---|
| 3,721,423 | 3/1973 | Shay | 251/100 |
| 3,782,605 | 1/1974 | Messenger | 222/153 |
| 4,420,096 | 12/1983 | Kirk, Jr. | 222/44 |
| 4,542,837 | 9/1985 | Rayner | 222/402.11 |

*Primary Examiner*—Andres Kashnikow
*Assistant Examiner*—Philippe Derakshani
*Attorney, Agent, or Firm*—Watson, Cole, Grindle & Watson

[57] ABSTRACT

A manually operated childproof dispenser has a plunger head located at an upper end of a housing and is axially displaceable from an initial position and rotatable relative to the housing. The plunger head has an annular skirt with a notch. A ring having a notch surrounds and is rotatable about the skirt. The ring is axially displaceable together with the plunger head. A dispensing nozzle extends radially outward from the housing and is located below the ring. The notches are aligned with the nozzle to facilitate depression of the plunger head to dispense the desired product.

3 Claims, 1 Drawing Sheet

CHILDPROOF DISPENSER

BACKGROUND OF THE INVENTION

1. Technical Field of the Invention

The present invention relates generally to manually operated dispensers and more particularly to childproof dispensers.

2. Discussion of the Related Art

Manually operated dispensers of aerosol and spray pump types are widely used to dispense a variety of products such as cleaning agents, insecticides, paint, beauty products, medicine, etc. These products are potentially hazardous to children who operate the container.

Many efforts have been made to make these dispensers childproof while at the same time accessible to adults. For example, it is known to provide a plunger head and a collar with slots and tabs. The tabs and slots are usually misaligned, which prevents the plunger head from being depressed. The potential user must rotate the plunger head relative to the collar to align the slots and tabs in order to depress the plunger head and dispense the contained substance. Such a manipulation requires coordination not ordinarily possessed by young children. On the other hand, adults usually have sufficient coordination and strength to align the relatively moving elements of the dispenser. However, this dispenser is relatively complicated to manufacture and requires that material be expended to produce the single function tabs.

Accordingly, it is an object of the present invention to provide a manually operated childproof dispenser which effectively uses production materials.

A further object of the present invention is to provide such a childproof dispenser which is easily manipulated by adults.

Another object of the present invention is to provide such a childproof dispenser which is simply manufactured Other objects and advantages of the present invention are apparent in the specification and drawings which follow.

SUMMARY OF THE INVENTION

The foregoing and additional objects are achieved by a manually operated childproof dispenser according to the present invention. This dispenser includes a plunger head located at an upper end of a housing. The plunger head is axially displaceable from an initial position and rotatable relative to the housing. An annular skirt having a notch is fixed to a lower end of the plunger head. A ring having a notch surrounds the skirt and is rotatable about the skirt. The ring is axially displaceable together with the plunger head. A dispensing nozzle extends radially outward from the housing below the ring. To use the childproof dispenser, the user aligns the notches above the nozzle and then depresses the plunger head to dispense the desired product.

DETAILED DESCRIPTION OF THE PREFERRED EMBODIMENTS

Figure 1:
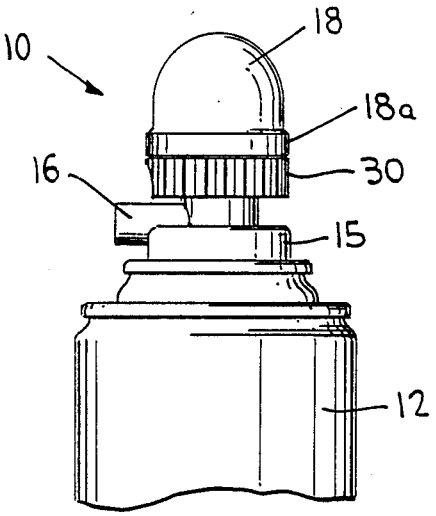
FIG. 1 is a side elevational view of the actuator according to the present invention.
Figure 3:
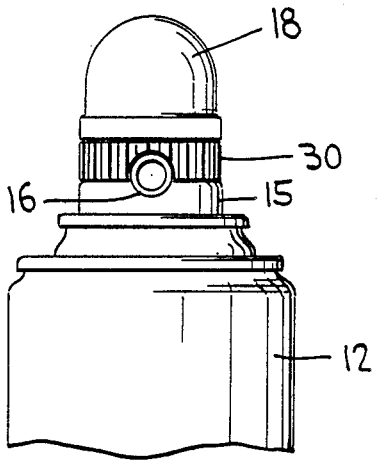
FIG. 3 is a front view of the actuator in an aligned, and therefore operable, position.
Figure 2:
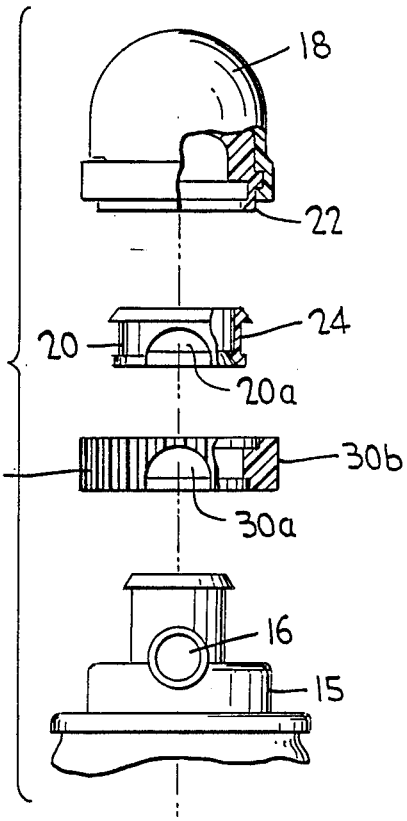
FIG. 2 is an exploded view, partly in section, of the actuator.

Referring to FIGS. 1 and 2, a manually operated childproof dispenser 10 is shown. A generally cylindrical supply container 12 is provided for containing the product to be dispensed. A housing 15 is attached to an upper end of container 12 and is preferably fixed relative to container 12. Container 12 also houses a stem for supplying the liquid from the container to a barrel shaped dispensing nozzle 16. Nozzle 16 extends radially outward from housing 15 and may be fixed or rotatable relative to housing 15.

An axially displaceable plunger head 18 is provided at an upper end of the housing 15 and communicates with the stem. Specifically, when plunger head 18 is depressed axially relative to the container from an initial position, fluid is supplied from the container 12 via the stem to nozzle 16. Any well known method of fluid transmittal may be employed. For example, a spray pump method may be used wherein the depressed plunger head 18 activates a piston or plunger located in a cylinder within the stem. Alternatively, the depressed plunger head could dispense fluid and an aerosol propellant contained under pressure. The exact method utilized is a matter of design choice and the present invention is not limited to any particular conventional dispensing method.

Figure 4:
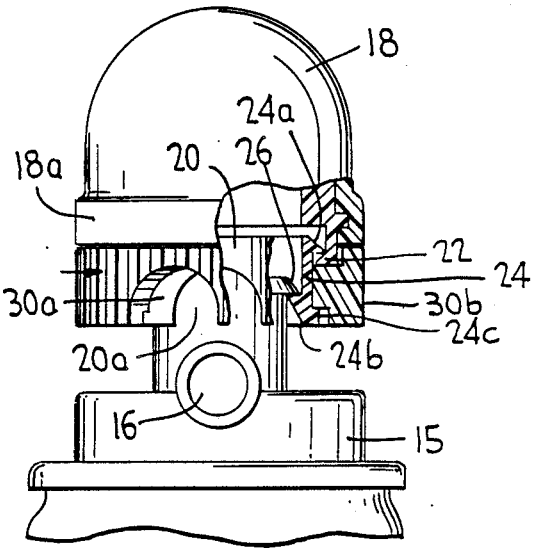
FIG. 4 is a front view, partly in section, of the actuator in an unaligned, and therefore inoperable, position.

An annular skirt 20 is provided having a notch **20*a* located in a lower portion of its annular wall. Skirt 20 is fixed to a lower end 18*a* of plunger head 18. As best seen in FIG. 4, a lip 22 of lower end 18*a* is frictionally fitted with an upper annular fitting piece 24*a* of piece 24 of skirt 20. A lower annular engagement piece 24*b* of skirt piece 24 rotatably engages a collar 26 of housing 15. Accordingly, plunger head 18 and annular skirt 20 are fixed relative to one another and rotatable with respect to the housing 15**.

An outer ring 30 is provided which has a notch **30*a* located in a lower portion of its annular wall. Ring 30 surrounds skirt 20 and is rotatable with respect to skirt 20 and to nozzle housing 15. Specifically, ring 30 is rotatably engaged about skirt 20 by a snap-fitted inner radial flange 30*b* rotatably contacting engagement piece 24*c* of skirt piece 24. Flange 30*b* abuts lip 22 and accordingly ring 30 is displaced axially together with plunger head 18** upon depression if alignment is present as discussed below.

Skirt notch **20*a* and ring notch 30*a* are each shaped so that if aligned they may fit around nozzle 16 when plunger head 18 is depressed. Notches 20*a* and 30*a* may be semicircular and have radii which are slightly greater than the radius of barrel shaped nozzle 16. Nozzle 16 extends radially outward past the lower portion of the annular wall of ring 30 when plunger head 18** is in its initial, undepressed position.

To operate the dispenser 10, a user must align skirt notch **20*a* with ring notch 30*a* at a point above extending nozzle 16. To aid in this alignment, outer ring 30 may be transparent. Also, outer ring 30** may be ridged on its outer surface to provide an easily gripped surface. Once the notches and nozzle are aligned, the plunger head may be axially depressed an adequate amount to dispense the product.

After dispensing, the user simply rotates the plunger head 18 and ring 30 relative to each other and relative to nozzle 16. The resulting misalignment prevents subsequent use without realignment since upon depression the annular walls of ring 30 and/or skirt 20 will contact nozzle 16, thereby preventing plunger head 18 from being depressed a sufficient axial distance to dispense the product. Accordingly, children incapable of performing this alignment cannot dispense potentially hazardous products.

Unlike prior childproof dispensers, the present invention utilizes nozzle 16 both to dispense the liquid and to prevent unauthorized dispensing. Thus, manufacturing costs are reduced since less material is needed and a less complicated mold for the housing may be employed.

Although the preferred embodiments of the present invention have been disclosed and described in detail above, it should be understood that the invention is in no sense limited thereby and its scope is to be determined by that of the following claims.

What is claimed is:

1. A manually operated childproof dispenser for a container of product to be dispensed, comprising:

a housing;

a plunger head located at an upper end of the housing, said plunger being axially displaceable from an initial position and rotatable relative to said housing;

said plunger head having an annular skirt with a lower notch;

a relatively rotatable outer ring surrounding said skirt and being axially displaceable together with said plunger head, said ring having a notch in a lower portion thereof which is alignable with the skirt notch upon relative rotation between said ring and said skirt; and a dispensing nozzle extending radially outward from the housing below said ring;

whereby the ring notch and the skirt notch may be aligned with said nozzle to facilitate axial displacement of said plunger head to dispense the product from the container.

2. The dispenser according to claim 1, wherein said nozzle is barrel-shaped and the skirt and ring notches are semicircles.

3. The dispenser according to claim 1, wherein said outer ring is ridged on its outer surface to facilitate rotation.

* * * * *